US012195990B2

(12) United States Patent
Yang

(10) Patent No.: US 12,195,990 B2
(45) Date of Patent: Jan. 14, 2025

(54) TENT AND TOP STRUCTURE THEREOF

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 165 days.

(21) Appl. No.: 18/097,531

(22) Filed: Jan. 17, 2023

(65) Prior Publication Data

US 2024/0110406 A1 Apr. 4, 2024

(30) Foreign Application Priority Data

Sep. 30, 2022 (CN) ..... 202222613161.0

(51) Int. Cl.
*E04H 15/48* (2006.01)

(52) U.S. Cl.
CPC ..... *E04H 15/48* (2013.01)

(58) Field of Classification Search
CPC ..... E04H 15/48
USPC ..... 135/135, 147, 159, 120.3
See application file for complete search history.

(56) References Cited

U.S. PATENT DOCUMENTS 7,861,736 B2 * 1/2011 Choi ..... E04H 15/48 135/905
9,382,723 B2 7/2016 Choi
10,337,204 B2 7/2019 Choi
2007/0051398 A1 * 3/2007 Kim ..... E04H 15/28 135/135
2011/0214706 A1 * 9/2011 Seo ..... E04H 15/42 135/147
2014/0202511 A1 * 7/2014 Choi ..... E04H 15/48 135/120.3
2014/0338710 A1 * 11/2014 Huang ..... E04H 15/32 135/120.3
2024/0060327 A1 * 2/2024 Park ..... E04H 15/48

FOREIGN PATENT DOCUMENTS

CN 203755790 U * 8/2014
CN 114183011 A * 3/2022
KR 20090091876 A * 8/2009
WO WO-2007123314 A1 * 11/2007 ..... E04H 15/28

* cited by examiner

*Primary Examiner* — David R Dunn
*Assistant Examiner* — Danielle Jackson
(74) *Attorney, Agent, or Firm* — Thompson Coburn LLP

(57) ABSTRACT

A tent has a top structure that includes a seat body and at least two groups of support structures. The seat body comprises a top seat and a base arranged below the top seat. Each support structure in the at least two groups of support structures comprises a brace rod and a folding mechanism. The brace rod is rotatably connected to the top seat. The folding mechanism is arranged between the base and the brace rod. The brace rod has an unfolded state in which the brace rod is expanded outwards relative to the top seat and a folded state in which the brace rod is folded downwards relative to the top seat. The folding mechanism is configured to urge the brace rod from the folded state and the unfolded state.

13 Claims, 4 Drawing Sheets

TENT AND TOP STRUCTURE THEREOF

RELATED APPLICATION DATA

This application claims priority benefit to Chinese utility model application serial no. 202222613161.0, which was filed on Sep. 30, 2022, the disclosure of which is incorporated by reference herein.

FIELD

The present application relates to a tent and a top structure thereof.

BACKGROUND

In an existing top folding structure for a conventional tent, frame rods are folded upwards, and the folding condition is limited by the size of the bottom plate of the product, so that the product cannot be enlarged when the structure is used in product design.

SUMMARY

As set forth in the disclosure that follows, a top structure of a tent is provided which solves the issues of conventional tents and their respective top structures. According to the present application, a top structure of a tent includes a seat body and at least two groups of support structures. The seat body includes a top seat and a base arranged below the top seat. Each support structure includes a brace rod and a folding mechanism. The brace rod is rotatably connected to the top seat, and the folding mechanism is arranged between the base and the brace rod. The brace rod has an unfolded state in which the brace rod is expanded outwards relative to the top seat and a folded state in which the brace rod is folded downwards relative to the top seat. The folding mechanism can drive the brace rod to switch between the folded state and the unfolded state.

Preferably, a vertically extending sliding rail is formed on the base, and the folding mechanism is in a sliding fit with the sliding rail.

Preferably, the folding mechanism includes a linkage slider mechanism and an elastic member. The linkage slider mechanism is in a sliding fit with the sliding rail, and the elastic member urges the linkage slider mechanism to support the brace rod in the unfolded state.

Preferably, the linkage slider mechanism at least includes a connecting rod and a sliding block. A first end of the connecting rod is hinged with the brace rod, a second end of the connecting rod is hinged with the sliding block, and the sliding block is in sliding fit with the sliding rail.

Preferably, the base is provided with a sliding groove opened from top to bottom to form the sliding rail, and the sliding block is slidable in the sliding groove.

Preferably, a limiting part for limiting a stroke of the sliding block is formed at a top end of the sliding groove, and the elastic member is connected between the sliding block and the sliding groove.

Preferably, the limiting part is a limiting top formed at the top, and the limiting top is provided with an opening for part of the sliding block to extend out of the sliding groove and be hinged with the connecting rod.

Preferably, the elastic member is a spring.

Preferably, the connecting rod is hinged with the brace rod via a hinge seat, and the hinge seat allows the connecting rod to rotate from an inclined position suitable for supporting the brace rod to a vertical position coaxial with the spring.

Preferably, the connecting rod is hinged with the brace rod via a hinge seat, and the hinge seat allows the connecting rod to rotate from an inclined position suitable for supporting the brace rod to a vertical position coaxial with the spring.

Preferably, the sliding block includes a hinge part, a stop part and an abutting part. The hinge part is hinged with the second end of the connecting rod, and can enter the vertical sliding groove along the opening for vertical sliding. The stop part can cooperate with the limiting top to limit the movement stroke of the sliding block and abut against the spring to provide upward support force. The abutting part abuts against the spring. The sliding block includes a hinge part and a sliding part, where the hinge part is hinged with the second end of the connecting rod, and can enter the vertical sliding groove along the opening for vertical sliding. The sliding part is in sliding fit with the sliding groove and can cooperate with the limiting top to limit the movement stroke of the sliding block, and the sliding part abuts against the spring to generate an upward support force. The hinge seat is provided with a sleeve and a hinge part formed outside the sleeve, the sleeve is sleeved on the brace rod, and the hinge part is rotatably connected with the connecting rod.

A tent is further provided according to the present application, including a tent soft fabric and the above top structure of a tent, where the top structure of a tent is configured to unfold or fold the tent soft fabric.

The brace rods provided by the present application can be folded or unfolded independently, and the elastic member urges the brace rods to be unfolded or to the unfolded position. When folding, the brace rods are folded downwards against the elastic member. Compared with the existing way of folding the brace rods upwards, the folding volume of the top structure of a tent provided by the present application is reduced, and each brace rod is independently unfolded or folded, so that the folding process is gentle and controllable, and the safety is improved.

DETAILED DESCRIPTION OF THE EMBODIMENTS

Figure 1:
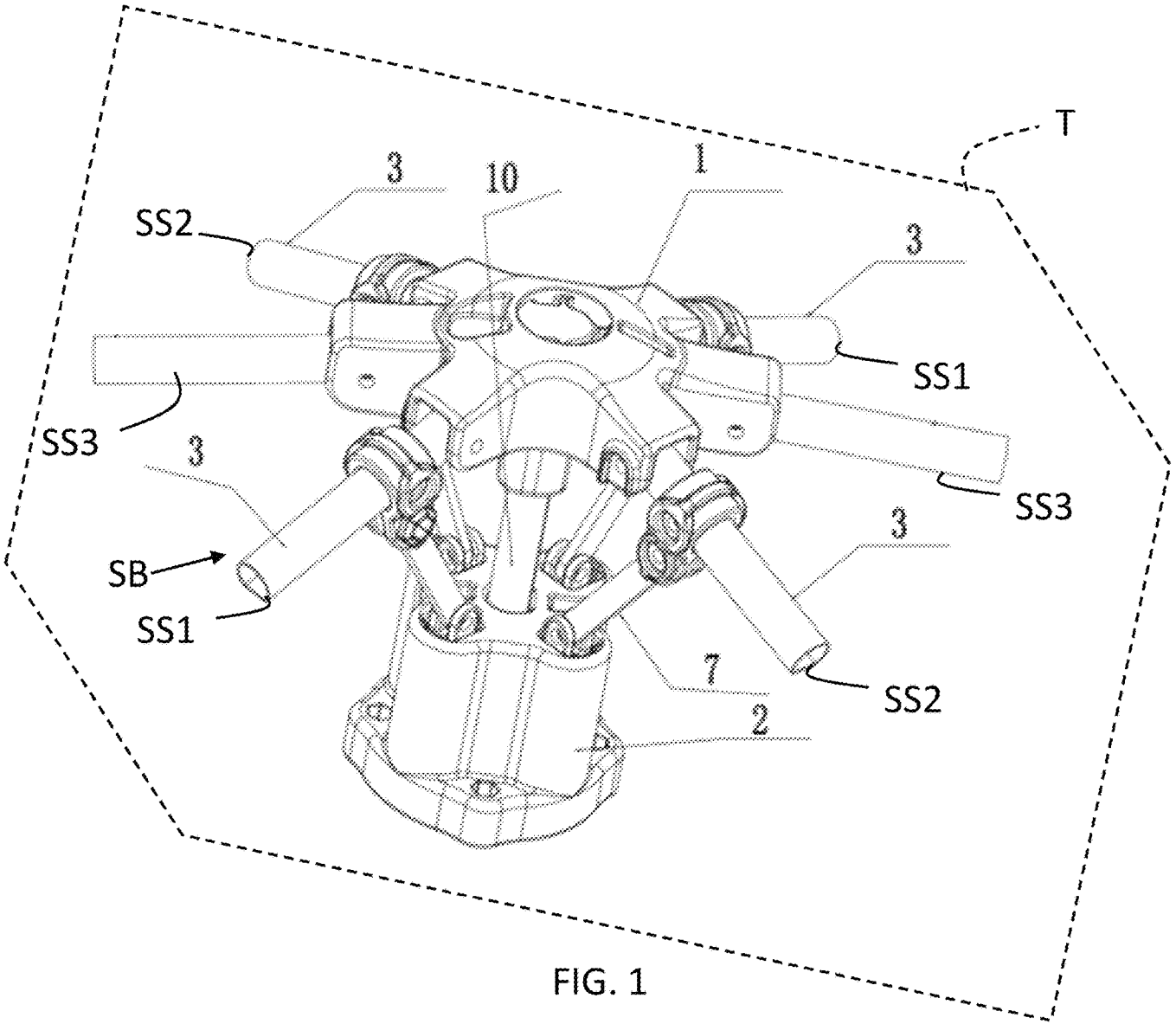
FIG. 1 is a schematic structural view of a top structure of a tent provided by the present application with the tent shown in phantom and the top structure shown in an unfolded configuration.

In the description of the present application, it should be appreciated that the orientations or positional relationships indicated by the terms such as "center", "upper", "lower", "front", "rear", "left", "right", "vertical", "horizontal", "top", "bottom", "inside", "outside", and "circumferential", are based on the orientation or positional relationship shown in the drawings, which are only used to facilitate the description of the present application and to simplify the description, rather than to indicate or imply that the devices or elements referred to must have a specific orientation or can only be configured and operated in a particular orientation. Therefore the above-mentioned terms should not be construed as a limitation to the present application.

In the description of the present application, it should be noted that, unless otherwise explicitly specified and defined, terms such as "installation", "link", and "connection" should be understood in a broad sense, for example, the terms may imply a fixed connection, a detachable connection, or an integral connection; a direct connection or an indirect connection through an intermediate medium; or an internal communication between two components. For those skilled in the art, the specific meaning of the above terms in the present application may be understood in the light of specific circumstances.

First Embodiment

Figure 2:
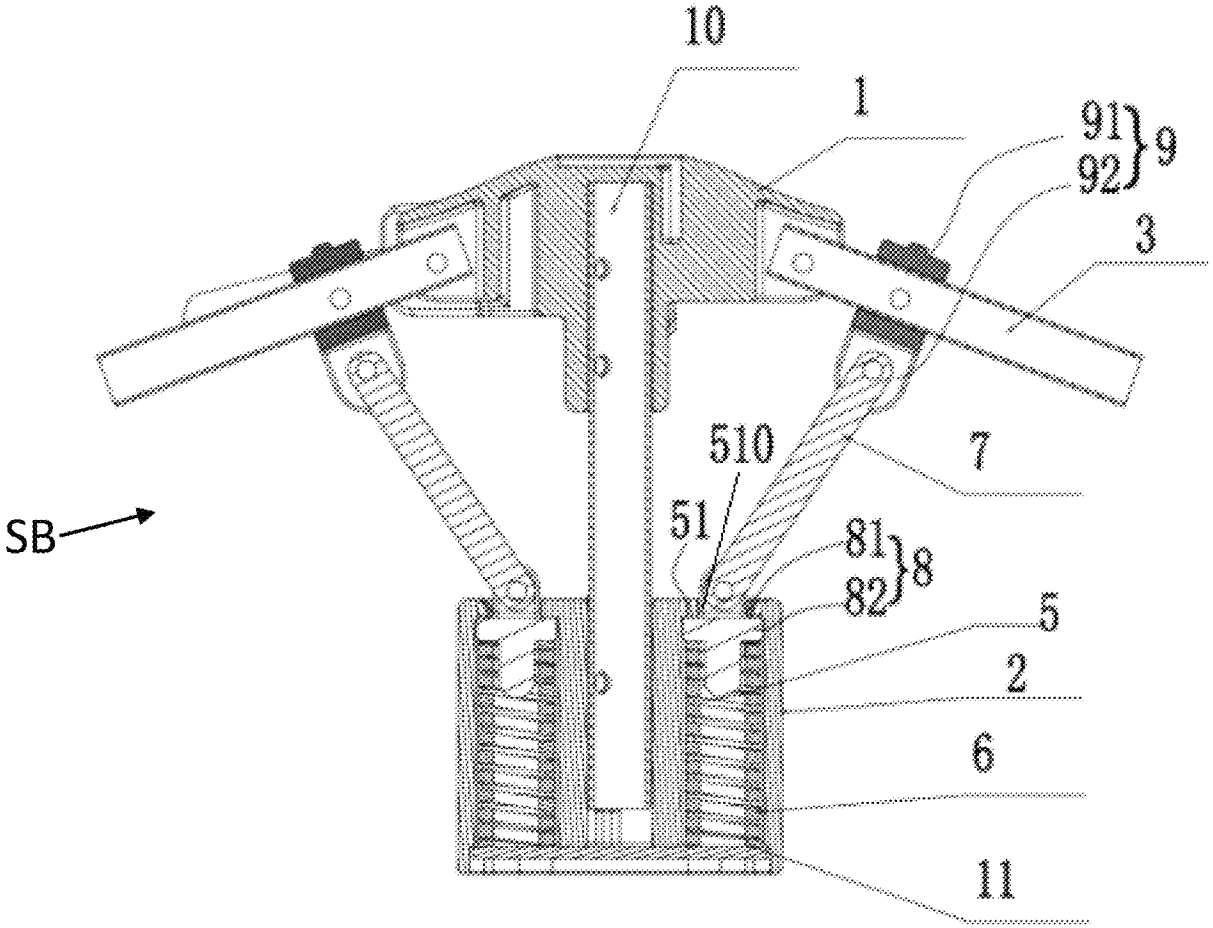
FIG. 2 is a sectional view of the top structure of a tent in an unfolded configuration.
Figure 3:
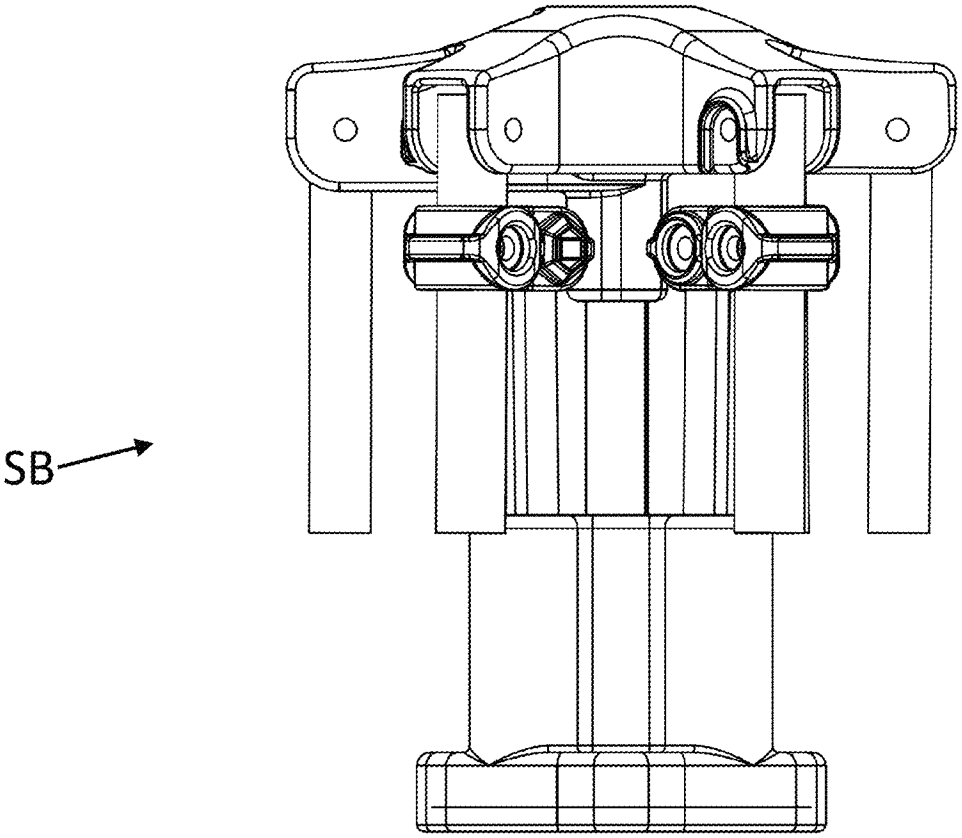
FIG. 3 is a schematic view of the top structure shown in the folded configuration.
Figure 4:
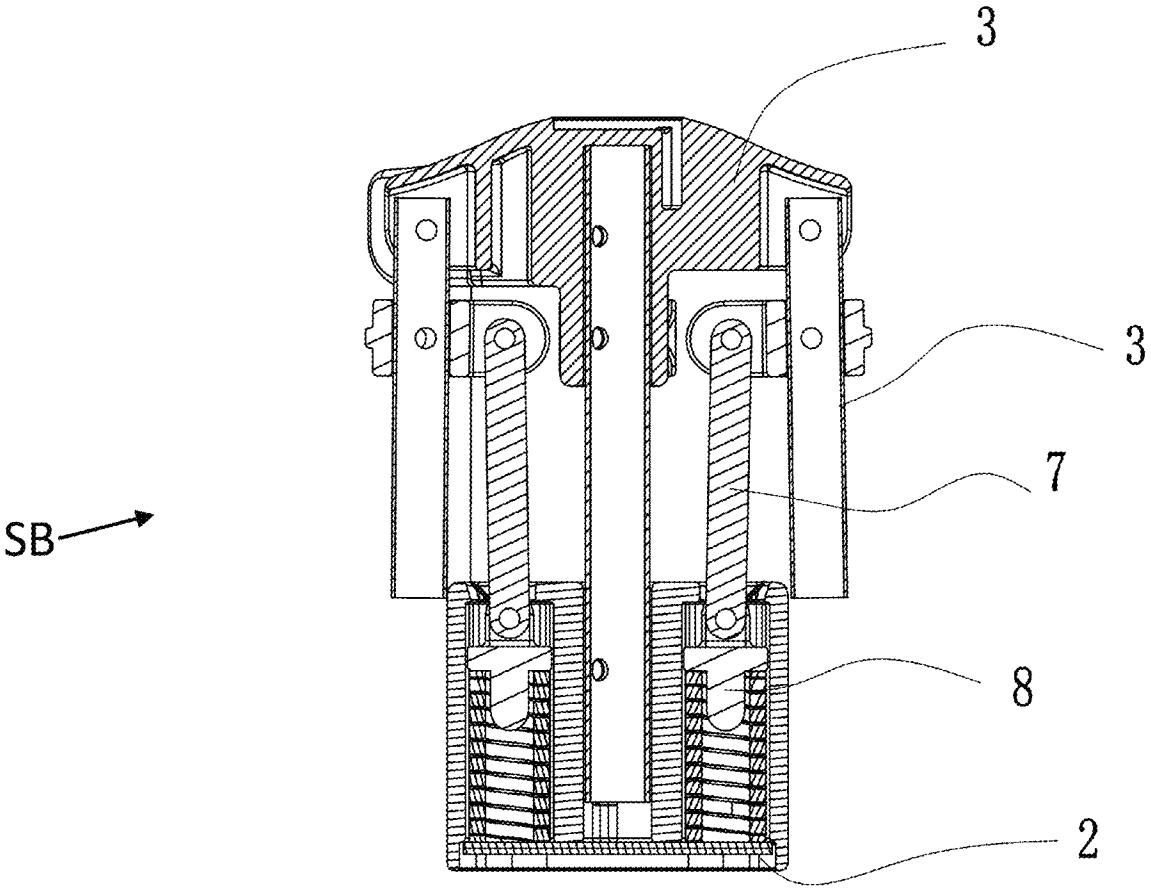
FIG. 4 is a sectional view of the top structure of a tent in a folded configuration.

Referring to FIG. 1 and FIG. 2, a top structure of a tent T is provided according to the present application, including a seat body SB and at least two groups of support structures SS1, SS2 suitable for unfolding or folding the tent. The seat body includes a top seat 1 and a base 2 arranged below the top seat. The support structures SS1,SS2 includes a brace rod 3 and a folding mechanism. Other support structures SS3 may include a brace rod that is solely pivotally connected with the top seat 1. The folding mechanism is arranged between the base 2 and the brace rod 3. The brace rod has an unfolded state in which the brace rod is expanded outwards relative to the top seat and a folded state in which the brace rod is folded downwards relative to the top seat, and the folding mechanism can drive the brace rod 3 to switch between the folded state (FIG. 3 and FIG. 4) and the unfolded state (FIG. 1 and FIG. 2).

With the top structure of a tent provided by the present application, the tent T can be unfolded or folded, and compared with the existing linkage folding or unfolding, the brace rod of the top structure of a tent provided by the present application can be unfolded or folded independently, and the folding or unfolding action is more controllable and safer. In addition, the brace rods 3 provided by the present application are folded downward in the folding process, which is contrary to the existing folding way, so that the folding condition is not limited by the size, and the product has a wider application range.

Referring to FIG. 1 to FIG. 4, in order to ensure that the folding structure can be folded downward or unfolded upward, a vertically extending sliding rail 5 is formed on the base 2, and the folding mechanism is in sliding fit with the sliding rail 5, so that each folding mechanism drives or urges the corresponding brace rod to unfold when each folding mechanism independently slides upward along the sliding rail. Each folding mechanism drives the corresponding brace rod to fold when each folding mechanism independently slides downward along the sliding rail, thereby realizing the independent unfolding or folding of each folding mechanism.

In some preferred embodiments, the folding mechanism includes a linkage slider mechanism and an elastic member 6. One end of the linkage slider mechanism is rotatably connected with the brace rod, and the other end of the linkage slider mechanism is in sliding fit with the sliding rail 5. The elastic member 6 is arranged to urge the linkage slider mechanism to support the brace rod 3 to be in the unfolded state. In this way, the brace rod hinged with the linkage slider mechanism can switch between the unfolded state and the folded state when the linkage slider mechanism slides vertically along the sliding rail. In some specific embodiments, the linkage slider mechanism at least includes a connecting rod 7 and a sliding block 8, where the connecting rod has a first end at the upper part and a second end at the lower part. A first end of the connecting rod 7 is hinged with the brace rod 3 and a second end of the connecting rod 7 is hinged with the sliding block 8. The sliding block is in sliding fit with the sliding rail. For example, the structure of the sliding rail 5 is as follows: the base is provided with a sliding groove opened from top to bottom to form the sliding rail, and the sliding block is slidable in the sliding groove.

As mentioned above, in order to unfold and fold the brace rod, the linkage slider mechanism needs to slide in a vertical direction, and the connecting rod 7 drives the sliding block 8 to slide along the vertical sliding groove forming the sliding rail 5. A limiting part 51 for limiting a stroke of the sliding block 8 is formed at a top end of the sliding groove. The elastic member 6 is connected between the sliding block 8 and the sliding groove. Specifically, the elastic member is a spring. The limiting part is a limiting top 51 formed at the top. The limiting top 51 defines an opening 510. The sliding block 8 includes a hinge part 81 and a sliding part 82. The hinge part 81 is hinged with the second end of the connecting rod 7, and can enter the vertical sliding groove along the opening for vertical sliding. The sliding part 82 is in sliding fit with the sliding groove and can cooperate with the limiting top 51 to limit the movement stroke of the sliding block 8. The sliding part 82 abuts against the spring to generate an upward support force. In this way, when the brace rod 3 is in the unfolded state, the connecting rod 7 is obliquely arranged, the sliding part 82 of the sliding block 8 is limited by the limiting top, the spring provides the upward support force to the connecting rod by the action of the sliding part 82, and transmits the support force to the brace rod, so that the brace rod is kept in the unfolded state. When a user needs to fold the tent, the brace rod is turned downward, the connecting rod drives the sliding block to vertically move along the sliding groove, the movement stroke of the sliding block determines the folding angle of the brace rod, the hinge part of the sliding block can pass through the opening and move along the sliding groove, and folding of the connecting rod 3 is achieved.

In some embodiments, the connecting rod is hinged with the brace rod via the hinge seat 9. It can be understood that in order to finally achieve the folding of the brace rod 3, the connecting rod does not generates support force on the brace rod when it is folded, and in the folded state the connecting rod 7 needs to be vertically directed, so that a dead point is formed between the connecting rod 7 and the brace rod 3. The hinge seat 9 therefore allows the connecting rod to rotate from an inclined position suitable for supporting the brace rod to a vertical position coaxial with the spring. In an embodiment, the hinge seat is provided with a sleeve 91 and a hinge part 92 formed outside the sleeve. The sleeve 91 is sleeved on the brace rod 3, and the hinge part 92 is rotatably connected with the connecting rod 7.

In this embodiment, the top seat 1 is connected with the base via a central rod 10, and the top structure includes six groups of support structures, where six brace rods are distributed along the circumference of the top seat, and can be independently unfolded or folded.

Second Embodiment

A tent including a tent soft fabric may be provided with the top structure of a tent described in the first embodiment, where the top structure of a tent is configured to unfold or fold the tent soft fabric.

In the description of this specification, description involving terms such as "embodiment" and "example", means that specific features, structures, materials or characteristics described in conjunction with this embodiment or example are included in at least one embodiment or example of the present application. In this specification, the exemplary expressions of the above terms do not necessarily refer to the same embodiments or examples. Furthermore, the specific features, structures, materials or characteristics described may be combined in a suitable manner in any one or more embodiments or examples.

Although the embodiments of the present application have been shown and described, those skilled in the art can understand that: various changes, modifications, substitutions and variations can be made to these embodiments without departing from the principles and purposes of the present application. The scope of the present application is defined by the claims and their equivalents.

The invention claimed is:

1. A tent, the tent having a top structure, the top structure comprising a seat body and at least two groups of support structures, wherein the seat body comprises a top seat and a base arranged below the top seat, wherein each support structure in the at least two groups of support structures comprises a brace rod and a folding mechanism, each brace rod is rotatably connected to the top seat, each folding mechanism is arranged between the base and the corresponding brace rod, each brace rod has an unfolded state in which the brace rod is expanded outwards relative to the top seat and a folded state in which the brace rod is folded downwards relative to the top seat, and each folding mechanism is configured to urge the corresponding brace rod from the folded state and the unfolded state; and wherein the base includes a sliding groove for each folding mechanism, each sliding groove is fixed in position on the base, and each folding mechanism is in sliding fit with the corresponding sliding groove.

2. The tent according to claim 1, wherein the top seat is connected with the base via a central rod.

3. The tent according to claim 1, wherein the top structure comprises at least three groups of support structures, and at least three brace rods are distributed along the circumference of the top seat.

4. A tent, the tent having a top structure, the top structure comprising a seat body and at least two groups of support structures, wherein the seat body comprises a top seat and a base arranged below the top seat, wherein each support structure in the at least two groups of support structures comprises a brace rod and a folding mechanism, each brace rod is rotatably connected to the top seat, each folding mechanism is arranged between the base and the corresponding brace rod, each brace rod has an unfolded state in which the brace rod is expanded outwards relative to the top seat and a folded state in which the brace rod is folded downwards relative to the top seat, and each folding mechanism is configured to urge the corresponding brace rod from the folded state and the unfolded state; and wherein the base includes a sliding groove for each folding mechanism, each sliding groove is formed vertically on the base, and the folding mechanism is in sliding fit with the sliding groove.

5. The tent according to claim 4, wherein each folding mechanism comprises a linkage slider mechanism and an elastic member, wherein one end of each linkage slider mechanism is rotatably connected with each brace rod, and the other end of each linkage slider mechanism is in sliding fit with the corresponding sliding groove, and each elastic member is configured to urge the corresponding linkage slider mechanism to support each brace rod from the folded state and the unfolded state.

6. The tent according to claim 5, wherein each elastic member is a spring.

7. A tent, the tent having a top structure, the top structure comprising a seat body and at least two groups of support structures, wherein the seat body comprises a top seat and a base arranged below the top seat, wherein each support structure in the at least two groups of support structures comprises a brace rod and a folding mechanism, each brace rod is rotatably connected to the top seat, each folding mechanism is arranged between the base and the corresponding brace rod, each brace rod has an unfolded state in which the brace rod is expanded outwards relative to the top seat and a folded state in which the brace rod is folded downwards relative to the top seat, and each folding mechanism is configured to urge the corresponding brace rod from the folded state and the unfolded state;

wherein the base includes a sliding groove for each folding mechanism, and each folding mechanism is in sliding fit with each sliding groove;

wherein each folding mechanism comprises a linkage slider mechanism and an elastic member, wherein one end of each linkage slider mechanism is rotatably connected with each brace rod, and the other end of each linkage slider mechanism is in sliding fit with the corresponding sliding groove, and each elastic member is configured to urge the corresponding linkage slider mechanism to support each brace rod from the folded state and the unfolded state; and wherein each linkage slider mechanism comprises a connecting rod and a sliding block, wherein a first end of each connecting rod is hinged with each brace rod, a second end of each connecting rod is hinged with the corresponding sliding block, and each sliding block is in sliding fit with the corresponding sliding groove.

8. The tent according to claim 7, wherein each connecting rod is hinged with the corresponding brace rod via a hinge seat, and each hinge seat allows the corresponding connecting rod to rotate from an inclined position suitable for supporting the corresponding brace rod to a vertical position coaxial with the sliding groove.

9. The tent according to claim 8, wherein each hinge seat is provided with a sleeve and a hinge part formed outside the sleeve, each sleeve is sleeved on the corresponding brace rod, and each hinge part is rotatably connected with the corresponding connecting rod.

10. The tent according to claim 7, wherein a limiting part is formed at a top end of each sliding groove, each limiting part is adapted and configured to limit a stroke of the corresponding sliding block within the corresponding sliding groove.

11. The tent according to claim 10, wherein each elastic member is connected between the corresponding sliding block and the corresponding sliding groove.

12. The tent according to claim 11, wherein each limiting part is a limiting top formed at the top of the corresponding sliding groove in the base, and each limiting top is provided with an opening, each opening is formed to allow a portion of the corresponding sliding block to extend out of the corresponding sliding groove and accommodate the corresponding hinge connection with the connecting rod.

13. The tent according to claim 12, wherein each sliding block comprises a hinge part and a sliding part, each hinge part is hinged with the second end of the corresponding connecting rod and is configured to enter the sliding groove along the opening for vertical sliding; and each sliding part is configured to cooperate with the corresponding limiting top to limit the stroke of the corresponding sliding block, and is configured to abut against the corresponding spring to provide an upward support force.

* * * * *